United States Patent [19]

Heider

[11] 4,437,622

[45] Mar. 20, 1984

[54] WIRE ROLLER

[75] Inventor: Merle J. Heider, Humboldt, Iowa

[73] Assignee: Jet Co., Inc., Humboldt, Iowa

[21] Appl. No.: 196,657

[22] Filed: Oct. 14, 1980

[51] Int. Cl.[3] ..... B65H 75/42

[52] U.S. Cl. ..... 242/86.5 R; 224/42.03 R; 280/502; 248/214

[58] Field of Search ..... 242/86.5 R, 86.5 A, 242/85, 106, 54 R; 254/363, 380, 323–327, 279–281; 24/243 B, 248 SA; 248/214, 229, 226.2, 226.4; 224/42.03 R; 280/495, 498, 500, 502

[56] References Cited

U.S. PATENT DOCUMENTS

| | | | |
|---|---|---|---|
| 1,215,454 | 2/1917 | Winchell | 242/86.5 R |
| 1,315,970 | 9/1919 | King et al. | 254/363 X |
| 2,525,505 | 10/1950 | Wiedman | 280/502 |
| 2,569,843 | 10/1951 | Adler et al. | 280/502 |
| 2,673,095 | 3/1954 | Fulton | 280/502 |
| 2,747,893 | 5/1956 | Strand | 280/502 |
| 3,070,324 | 12/1962 | Bryman | 242/86.5 R |
| 3,643,886 | 2/1972 | Colton | 242/86.5 A |
| 4,127,295 | 11/1978 | Robinson | 242/86.5 R X |
| 4,278,214 | 7/1981 | Caldwell | 242/86.5 R X |

*Primary Examiner*—John M. Jillions

*Attorney, Agent, or Firm*—Zarley, McKee Thomte, Voorhees & Sease

[57] ABSTRACT

A wire roller includes a wire receiving spool rotatably supported on a frame adapted for support on a vehicle. The power means for rotating the spool includes an electric motor supported on the frame and coacting drive means on the motor and spool for rotating the spool in response to operation of the electric motor. The frame may be supported on a vehicle by a clamp assembly including a pair of coacting clamp jaws which are pivotally connected together by an adjustable connection for accommodating bumpers of various dimensions. A torque applicator is operatively associated with one clamp jaw for pivotally moving said clamp jaws into clamping engagement on a vehicle bumper.

1 Claim, 7 Drawing Figures

WIRE ROLLER

BACKGROUND OF THE INVENTION

The present invention is directed generally to wire rollers and more particularly to a wire roller which does not require a vehicle equipped with a power take-off for its operation and which includes means for supporting the wire roller on a vehicle bumper. Thus a new and improved vehicle bumper clamp is disclosed.

Wire rollers are commonly used by farmers for laying out fence wire for a new fence and/or taking up wire removed from an existing fence. Such wire rollers have commonly been designed for connection to the power take-off of an agricultural tractor. The power take-off serves both to partially support the wire roller on the tractor and to provide the drive power for rotating the wire spool for rolling up and unrolling wire. Accordingly, the use of wire rollers has generally been limited by the availability of an agricultural tractor equipped with a power take-off. There is a need therefore for a wire roller which does not require a power take-off for its support and operation and which is readily adapted for use on most automotive vehicles.

Accordingly, a primary object of the invention is to provide an improved wire roller.

Another object is to provide a wire roller equipped with an electrically powered drive system for the wire spool.

Another object is to provide a wire roller equipped with means for mounting it on the bumpers of most automotive vehicles.

Another object is to provide a wire roller which may be quickly and easily mounted onto and electrically connected to an automotive vehicle for supporting and rotating the wire receiving spool.

Another object is to provide an improved wire roller which is simple in construction and efficient in operation.

Finally, another object is to provide a new and improved vehicle bumper clamp.

SUMMARY OF THE INVENTION

The wire roller of the present invention includes a frame adapted for support on a vehicle, a wire receiving spool rotatably supported on the frame and an electric motor carried on the frame adjacent the spool for rotating the same. A coacting drive mechanism on the motor output shaft and spool is operative to rotate the spool in response to operation of the electric motor. The drive mechanism may include a drive wheel mounted on the motor output shaft for frictionally engaging a drive collar on the wire spool to rotate the same.

The wire roller is supported on a vehicle bumper by a clamp assembly including a pair of coacting clamp jaws which each include an outwardly extended foot portion. The clamp jaws are pivotally connected together with the foot portions extending outwardly in spaced apart relation for receiving a vehicle bumper between them. Finally, a torque applicator associated with one jaw is operative to pivot the clamp jaws relative to one another thereby to urge the foot portions toward one another in clamping engagement on a vehicle bumper. The pivotal connection between clamp jaws may be adjustable to various positions for accommodating bumpers of various dimensions.

DESCRIPTION OF THE PREFERRED EMBODIMENT

Figure 1:
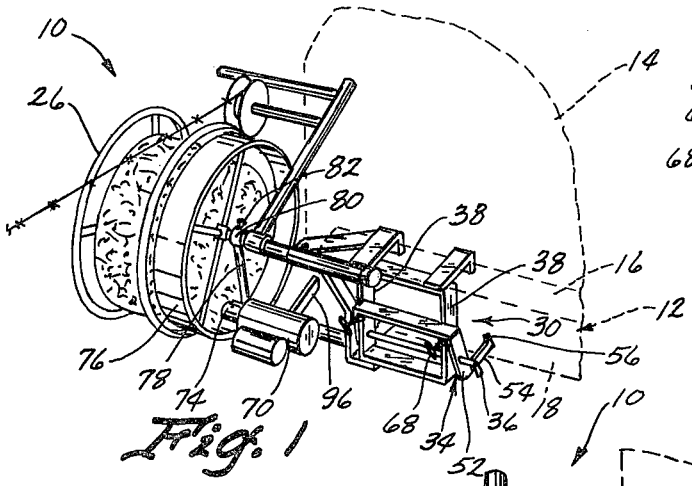
FIG. 1 is a perspective view of the wire roller supported on the bumper of a vehicle indicated in dotted lines.

The wire roller 10 of the present invention is shown in FIG. 1 mounted on the bumper 12 of an automotive vehicle 14. The bumper includes a top wall 16, rear wall 18, bottom wall 20 and upper and lower front edges 22 and 24 respectively.

Wire roller 10 generally includes a large wire receiving spool 26 rotatably supported on a frame 28 which is shown as an elongated shaft. Shaft 28 is, in turn, supported on the vehicle 14 by a bumper clamp 30.

Figure 4:
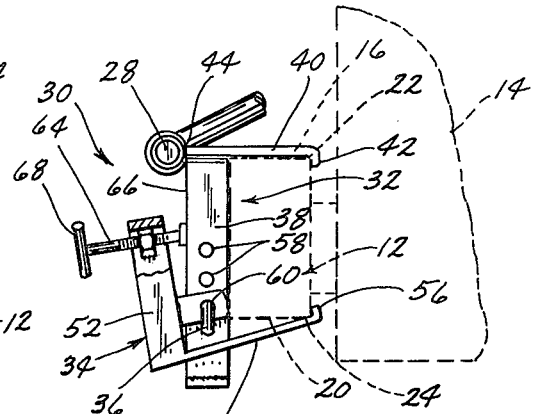
FIG. 4 is a partially sectional side view of the bumper clamp as seen on line 4—4 in FIG. 3.
Figure 2:
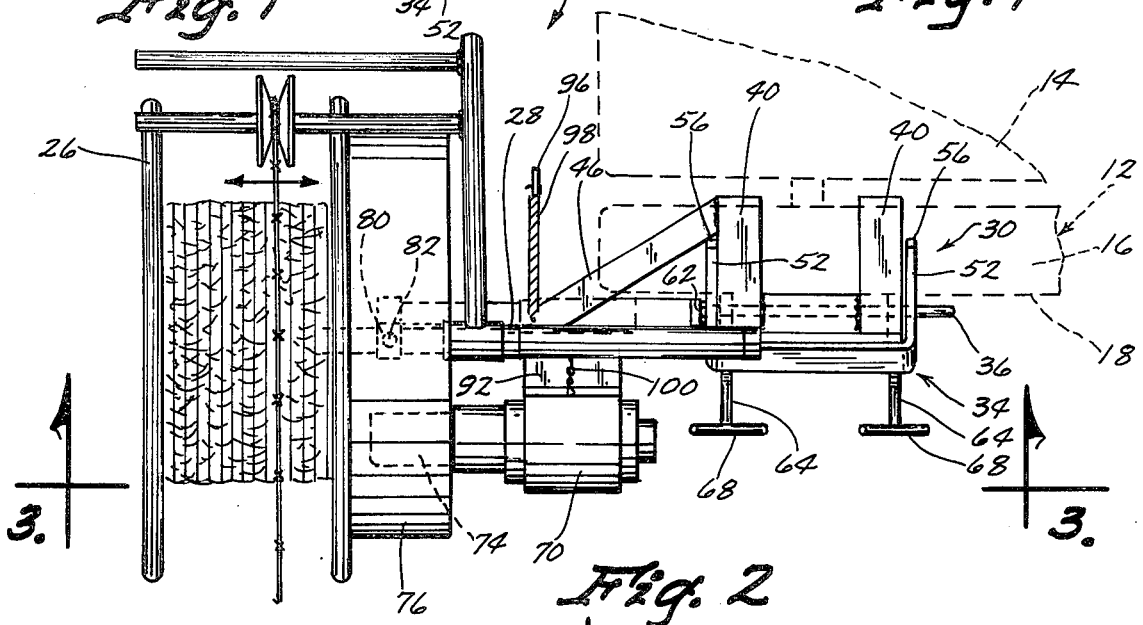
FIG. 2 is an enlarged top view of the wire roller and vehicle of claim 1.
Figure 3:
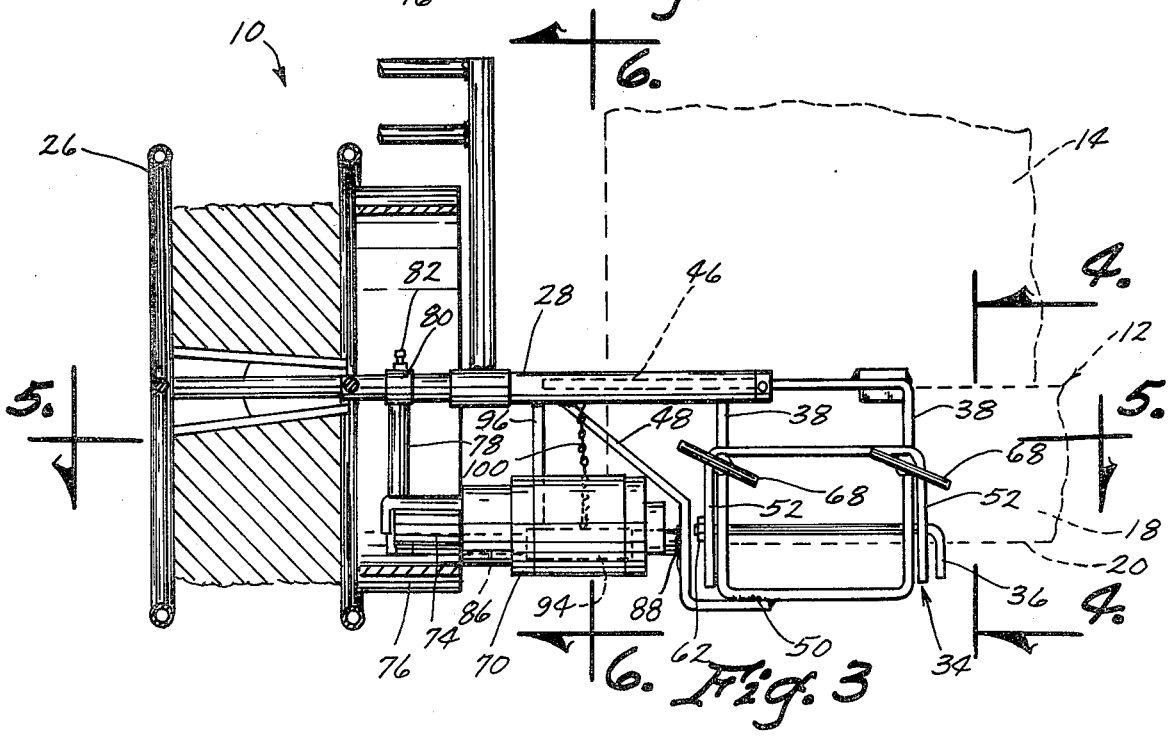
FIG. 3 is a rear elevational view of the wire roller as seen on line 3—3 in FIG. 2.

Bumper clamp 30 is seen in FIG. 4 as including a pair of coacting clamp jaws 32 and 34 which are pivotally connected together by a pin 36. In FIG. 1, it is seen that clamp jaw 32 consists of a rectangular frame including a pair of upstanding spaced apart leg members 38 which are interconnected at the top and bottom and which include a pair of forwardly extended and spaced apart foot portions 40 which are adapted to overlie the bumper top wall 16 when leg members 38 are engaged against the bumper rear wall 18. A depending flange 42 on the free end of foot portion 40 is engageable with the upper front edge 22 of the bumper to secure the wire roller in place until the lower clamp jaw 34 is applied and furthermore to prevent the direct rearward withdrawal of the clamp 30 from the bumper 12. The frame shaft 28 is secured to the upper clamp jaw 32 such as by the weldment indicated at 44. In addition, a generally horizontal rearwardly and outwardly inclined bracket 46 (FIG. 2) secures the shaft 28 relative to the outermost foot portion 40 and an upwardly and outwardly inclined bracket 48 (FIG. 3) which is welded to the bottom of upper clamp jaw 32 at 50, vertically supports the medial portion of shaft 28.

The lower clamp jaw 34 is an inverted U-shaped structure including a pair of generally upstanding leg members 52 interconnected at their upper ends and including a pair of forwardly extended foot portions 54 at their lower ends. The foot portions 54 may likewise be provided with upstanding flanges 56 on the forward ends thereof for engaging the bumper lower front edge 24 as indicated in FIG. 4.

To pivotally connect the upper and lower clamp jaws 32 and 34, the leg members 38 of upper clamp jaw 32 are each provided with a plurality of vertically spaced apart holes 58. The leg members 52 of lower clamp jaw 34 are likewise each provided with a hole 60 adapted for registration with a selected one of the holes 58 in the adjacent upper clamp jaw 32. The bent end pivot pin 36 is then inserted into the registered holes and secured therein by a nut 62.

To tighten the clamp 30 onto the bumper 12, the upper end of each leg member 52 on the lower clamp jaw 34 threadably carries a generally forwardly extended screw 64 at a position for engagement with a rear edge 66 of the upper clamp jaw leg members 38. Accordingly, as screws 64 are rotated in a clockwise direction by handles 68, the lower clamp jaw 34 is pivoted counterclockwise about pivot pin 36 forcing the foot portion 54 thereof upwardly in clamping engagement against the bottom wall 20 of bumper 12.

To disengage the bumper clamp 30 from bumper 12, it is only necessary to rotate the screws 64 counterclockwise to enable a clockwise pivotal movement of lower clamp jaw 34 as seen in FIG. 4 to pivotally move the foot portions 54 away from the bumper. The wire roller 10 can then simply be lifted to disengage the flanges 42 from the upper front edge 22 of the bumper. Thus, once the screws 64 are rotated to disengage the lower clamp jaw 34 from the bumper, the wire roller 10 may be quickly and easily lifted from the bumper thereby freeing the vehicle 14 for other purposes.

Figure 5:
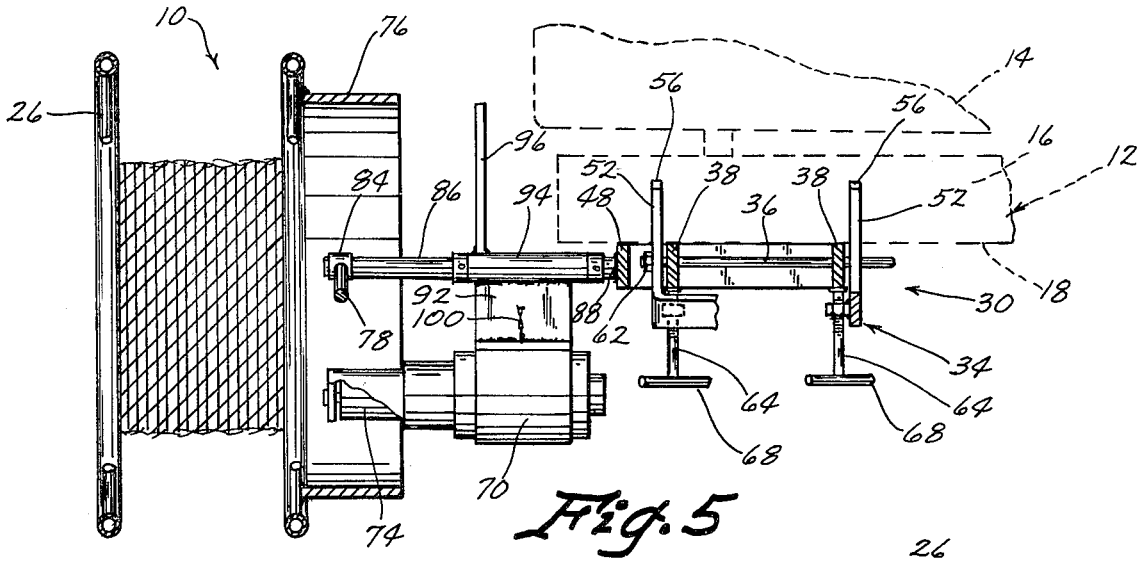
FIG. 5 is a top sectional view of the wire roller taken along line 5—5 in FIG. 3.
Figure 6:
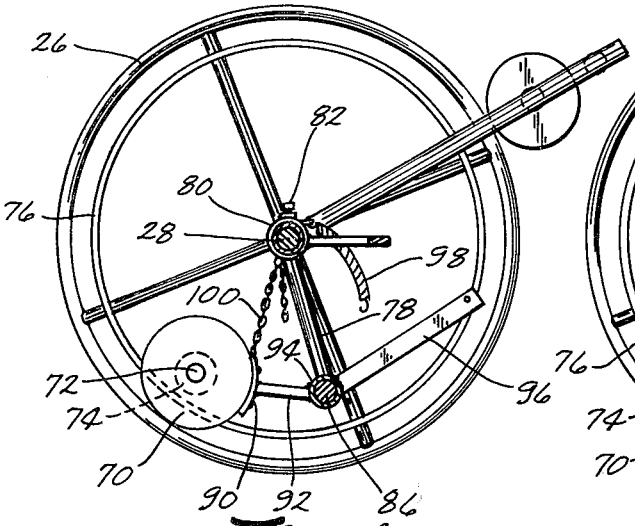
FIG. 6 is a side sectional view taken along line 6—6 in FIG. 3.
Figure 7:
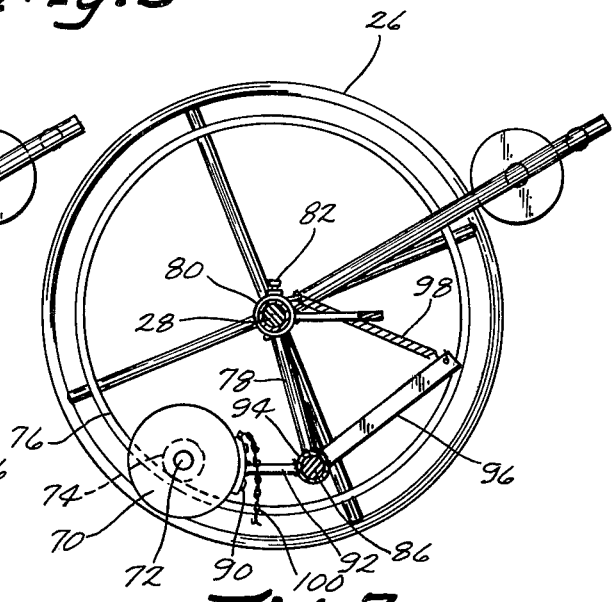
FIG. 7 is a side sectional view similar to FIG. 6 but showing the motor in an alternate engaged position.

In order to rotate the wire spool 26 on the frame shaft 28, there is provided an electric motor 70 having an output shaft 72 which carries a drive wheel 74 as seen in FIGS. 5–7. Drive wheel 74 is adapted to frictionally engage the inner peripheral surface of a collecting drive collar 76 which is mounted on the spool 26 concentrically therewith.

Electric motor 70 is indirectly pivotally supported on frame shaft 28 for movement between the working or engaged position of FIG. 7 and the non-working or disengaged position of FIG. 6. Specifically, the embodiment shown in the drawings provides a support arm 78 which is secured at its upper end to the frame shaft 28 by a collar 80 and set screw 82. A similar collar 84 at the lower end of support arm 78 secures one end of a shaft 86, the other end of which is fixed relative to bracket 48 such as by weldment 88. The electric motor 70 is bolted to a mounting flange 90 that is connected by plate 92 to a pivotal sleeve 94 on the motor support shaft 86. A lever 96 is also fixed to sleeve 94 and extends radially therefrom in a direction opposite from plate 92.

The weight of electric motor 70 therefore naturally tends to pivot the motor support arm 78 to the position of FIG. 7 so that the drive wheel 74 engages drive collar 76. In addition, a tension spring 98 which is connected at one end to the frame shaft 28 is disengageably connected at its other end to the free end of lever 96 to further bias drive wheel 74 into frictional engagement with the drive collar 76.

Disengagement of drive wheel 74 from drive collar 76 is easily accomplished by simply disengaging spring 98 from lever 96 and supporting the electric motor from the frame shaft 28 by a chain 100 at a sufficient elevation that the drive wheel 74 is supported in clearance relation from the drive collar 76.

Whereas the invention has been described in connection with the preferred embodiment shown in the drawings, it is understood that many modifications, substitutions and alterations may be made without departing from the broad scope of the invention as defined in the appended claims. For example, the drive connection between the electric motor and wire spool could alternately be provided as a chain or belt drive arrangement although the natural slippage afforded by the coacting drive wheel and drive collar should then be compensated for by a spring clutch or the like.

The wire roller of the present invention is thus readily adapted for use with almost any tool or four-wheel drive automotive vehicle having a bumper or similar structure onto which the wire roller may be clamped. No power take-off is necessary since the electric motor 70 may be provided as a 12-volt DC motor for accepting electrical power directly from the alternator or rechargeable battery of the vehicle on which the wire roller is mounted. The bumper clamp assembly of the present invention could alternately be used to support a trailer hitch for pulling another vehicle or trailer. The adjustability of the bumper clamp afforded by both the pivotal connection and screw fasteners makes it universally adaptable for securement to any automotive bumper.

Thus there has been shown and described an improved wire roller which accomplishes at least all of the stated objects.

I claim:

1. A wire roller, comprising a frame, means for supporting said frame on a vehicle, a wire receiving spool, means for rotatably supporting said spool on said frame, and power means for rotating said spool, said power means including an electric motor having an output shaft, means for supporting said motor on said frame adjacent said spool, and coacting drive means on said motor output shaft and spool, said coacting drive means being operative to rotate said spool in response to operation of said electric motor, said means for supporting said frame on a vehicle including a clamp assembly, comprising an upper clamp jaw including a pair of upstanding laterally spaced apart upper leg members, means rigidly interconnecting said upper leg members, a pair of upper foot portions secured to and extended forwardly from upper portions of said upper leg members thereby to overlie the top of a vehicle bumper when said upper leg members are engaged against a rear wall of said bumper and a pair of depending flanges on the forward ends of said respective pair of upper foot portions for engagement with an upper front edge of said bumper, said frame being rigidly connected to said upper clamp jaw, a lower clamp jaw including an inverted generally U-shaped structure including a pair of generally upstanding lower leg members interconnected adjacent their upper ends and including a pair of forwardly extended lower foot portions at the lower ends thereof and upstanding flanges on forward ends of said lower foot portions for engagement with a lower front edge of said bumper, means for pivotally connecting said leg members of said upper and lower clamp jaws together with said foot portions extending outwardly therefrom in vertically spaced apart relation for receiving a vehicle bumper therebetween, said means for pivotally connecting said leg members together comprising a plurality of vertically spaced apart holes in each of the upstanding upper leg members of the upper clamp jaw and a hole in each of the lower leg members of the lower clamp jaw registered with selected ones of the holes in the upper leg members and an elongated pivot pin inserted into and removably secured in said selected registered holes, said leg members thereby being constrained to relative pivotal movement about the longitudinal axis of said pivot pin and torque application means comprising a screw means carried on the leg members of one of said clamp jaws and positioned for operative engagement with the leg members of the other clamp jaw thereby to pivot the lower leg members rearwardly and downwardly apart from the upper leg members and thereby urge the lower foot portions upwardly and rearwardly in clamping engagement on a vehicle bumper.

* * * * *